United States Patent [19]

Mangiarelli

[11] 4,168,834

[45] Sep. 25, 1979

[54] POCKET FOOTBALL GAME BOARD

[76] Inventor: Joseph A. Mangiarelli, 1075 Woodlawn Ave., Girard, Ohio 44420

[21] Appl. No.: 876,650

[22] Filed: Feb. 10, 1978

[51] Int. Cl.[2] ..... A63F 7/06

[52] U.S. Cl. ..... 273/247

[58] Field of Search ..... 273/94, 247, 285

[56] References Cited

U.S. PATENT DOCUMENTS

| | | | |
|---|---|---|---|
| 413,026 | 10/1889 | Catlin | 273/282 |
| 1,522,402 | 1/1925 | Wittkowski | 273/94 |
| 1,547,313 | 7/1925 | Foster | 273/93 R |
| 2,492,378 | 12/1949 | Conlon | 273/94 R X |
| 3,550,944 | 12/1970 | Chamberlin | 273/148 A |
| 3,729,130 | 4/1973 | Bortz | 273/94 R X |
| 4,003,580 | 1/1977 | Haffey, Jr. | 273/247 |

*Primary Examiner*—Richard C. Pinkham
*Assistant Examiner*—Scott L. Brown
*Attorney, Agent, or Firm*—Webster B. Harpman

[57] ABSTRACT

A pocket football game board includes three sections in a common foldable cover, one section holds a plurality of offense cards and a plurality of defense cards and a rotatable dial with indicia thereabout. A center section portrays a football field with a movable ball marker and a movable field marker. The third section includes a description board having indicia keyed to the rotatable dial. The pocket football game board thus provides for playing a complete football game.

4 Claims, 3 Drawing Figures

POCKET FOOTBALL GAME BOARD

BACKGROUND OF THE INVENTION

1. Field of the Invention

This invention relates to game boards on which a simulated football game can be played.

2. Description of the Prior Art

Prior game boards of this type have been proposed and one such board is described in U.S. Pat. No. 2,492,378 in which movable members representing opposing football teams are arranged on a representation of a football field.

The present invention differs from the structure of the prior art by providing choice of plays listed on separate cards, a rotatable dial to indicate the results of the chosen plays and movable ball and field markers arranged on the representation of the football field.

SUMMARY OF THE INVENTION

A pocket football game board takes the form of a foldable cover having three sections visible when opened. The center section includes a representation of a football field with slidable ball and field markers to provide a continual visual representation of the ball and its play, another section forms a container for a plurality of offensive play cards and defensive play cards along with a rotatable dial by which the players are directed to a description board which indicates the results of the particular play indicated by the rotatable dial.

DESCRIPTION OF THE PREFERRED EMBODIMENT

Figure 1:
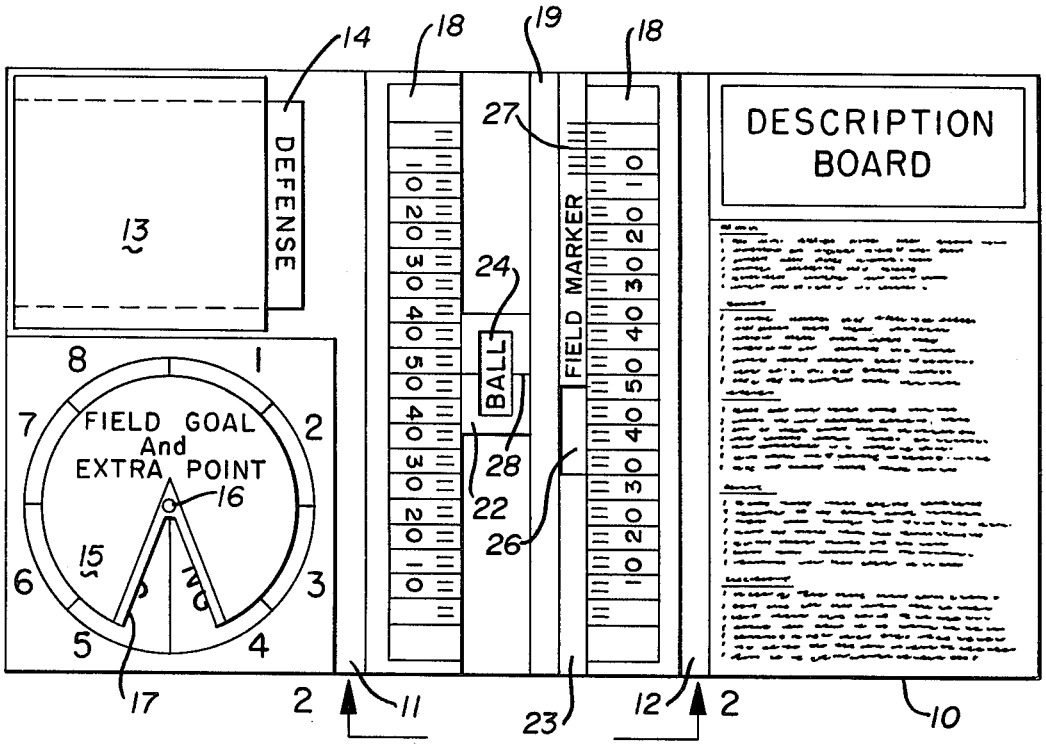
FIG. 1 is a plan view of the pocket football game board.
Figure 2:
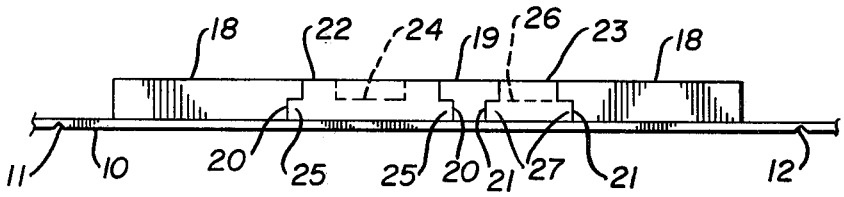
FIG. 2 is an enlarged end elevation on line 2—2 of FIG. 1.
Figure 3:
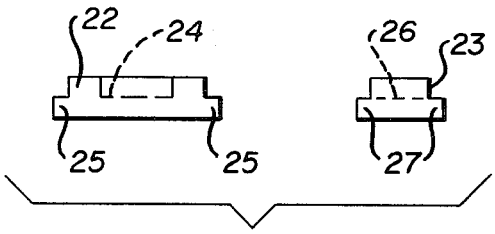
FIG. 3 is an enlarged end view of the movable ball and field markers seen in FIG. 2.

By referring to the drawings and FIG. 1 in particular, the form of the invention chosen for illustration and description herein may be seen to comprise a rectangular cover 10 having transversely extending fold lines 11 and 12 which divide the rectangular cover into three substantially equal portions. The first of these portions is the one to the left as seen in FIG. 1 of the drawings and it is provided with a pocket 13 in which a plurality of defense and offense play describing cards 14 are removably positioned. The first portion also includes a rotatable dial 15 which is pivoted as at 16 to the first portion. The dial 15 has a V-shaped cut out 17 arranged for registry with any one of a number of indicia that appear on the first portion beneath the dial 15 and circumferentially thereof. The circumferential indicia preferably comprise numerals 1 through 8. The indicia beneath the dial comprises the letters G and NG which stand for good and no good respectively.

The second or central portion of the pocket football game board comprises a representation of a football field and it is formed of slightly elevated spaced parallel members 18 on which the yard indications are shown. A slightly elevated longitudinally extending member 19 is positioned between the members 18 in spaced relation thereto and the opposing edges of the members 18 and 19 are undercut as at 20 and 21 so that a pair of slidable markers 22 and 23 may be movably retained thereby.

The marker 22 is preferably rectangular and has a central depressed area 24 in which the word ball appears and it therefore represents the football and is capable of movement back and forth on the second or central portion of the pocket football game board responsive to the plays chosen by the players and defined by the descriptions of the plays indicated by the chance selection of the rotary dial 15.

The longitudinal edges of the slidable marker 22 are provided with longitudinally extending flanges 25 for registry in the undercut edges 20 of the members 18 and 19.

The field marker 23 comprises an elongated strip having a depressed section 26 inwardly of its ends and a representation 27 of a ten yard down marker spaced with respect thereto. The depressed area 26 is preferably provided with a marking color such as red and in using the pocket football game board disclosed herein, the field marker strip 23 is removed and replaced so that the depressed area 26 indicates the goal toward which the ball is being moved. The yardage down indicator 27 is so positioned that by positioning the adjacent end of the field marker strip 23 on a transverse center line 28 of the ball marker 22 the down marker will be appropriately positioned to indicate the yardage necessary to achieve a first down and in the proper direction on the field.

The field marker 23 has longitudinally extending outwardly positioned flanges 27 on its longitudinal edges which underlie the edges of the members 18 and 19 and the respective undercut portions 21 therein as heretofore described.

It will occur to those skilled in the art that the pocket football game board disclosed herein may be used for playing a simulated football game with two players participating or one player playing against himself. If for example the player starting the game chooses to kick off the ball, the rotary dial 15 is actuated and the indicia indicated thereby co-related to the description board on the third portion of the game, the right hand portion as seen in FIG. 1 of the drawings. The ball marker is then placed where the kick off result is indicated by the description board and the field marker is positioned so that one end is on the same yard line as the ball and the other end toward the goal line. The offensive player chooses a card from the cards provided and places it face down. The defensive player not knowing which offensive play has been selected picks up a defense that he thinks will be suitable. The ball marker is then moved to show the gain or the loss and the field marker is moved forward only if the first down was made. The game is played with fifteen plays per quarter and when the second half begins the player that received at the beginning of the game now kicks off. Any punt that goes beyond the goal line is an automatic touch back, the ball is then moved to the twenty yard line. An incompleted pass is counted as a play and a down. If one player receives a penalty against him the other player can either refuse the penalty and move to the next down, or take the penalty and move the football the number of yards that the penalty calls for.

Variations in the manner of playing a simulated football game on the pocket football game board disclosed herein will occur to those skilled in the art and it will be apparent that by changing the shape and positioning of the members 18 and 19 a baseball field may be simulated and the same or a similar ball marker used to indicate the path of a baseball and a modified field marker used to indicate the advancement of the players around the bases, etc.

Although but one embodiment of the present invention has been illustrated and described, it will be apparent to those skilled in the art that various changes and modifications may be made therein without departing from the spirit of the invention and having thus described my invention what I claim is:

1. A pocket football game board comprises a cover section divided into three side by side portions by transverse fold lines, one of said portions having spaced longitudinally extending guide members, a pair of slidable markers positioned between said guide members, one of said markers representing a football and the other comprising a field marker, said field marker comprising an elongated member, the length of which is substantially the same as the longitudinally extending guide members and wherein yard line indications are formed adjacent the one end thereof and a depressed area is formed inwardly of the ends thereof so as to indicate the end of the football field area comprising the goal, said field marker being reversible between said guide members, said one portion representing a football field area having said yard line indications, a rotatable dial and indicia adjacent thereto on another of said three portions and indicia on still another of said three portions forming descriptions of various plays and results coded to said indicia adjacent said rotatable dial, a plurality of cards for use with said game board, said cards having indicia thereon, said indicia on said cards describing offensive and defensive plays and means on one of said three portions for holding said cards.

2. The pocket football game board set forth in claim 1 and wherein said marker representing said football is relatively small as compared with said portion representing the football field and movable between said guide members from one end thereof to the other adjacent said yard line indications.

3. The pocket football game board set forth in claim 1 and wherein said yard line indications are formed on at least one of said longitudinally extending guide members.

4. The pocket football game set forth in claim 1 and wherein said longitudinally extending guide members have longitudinally extending undercut edges and said slidable markers have longitudinally extending flanges arranged for registry in said undercut edges.

* * * * *